United States Patent [19]

Johnson

[11] 4,437,272

[45] Mar. 20, 1984

[54] INSERT FOR FOLDABLE CONCRETE BUILDING CONSTRUCTION WITH PIVOT CONNECTIONS, INTEGRAL LIFTING BAR, AND BUILDING HEIGHT CONTROL BAR

[76] Inventor: Delp W. Johnson, 240 Oakview Dr., San Carlos, Calif. 94070

[21] Appl. No.: 343,438

[22] Filed: Jan. 28, 1982

[51] Int. Cl.[3] ..... E04B 1/344; E04B 1/35; E04G 21/14

[52] U.S. Cl. ..... 52/64; 52/69; 52/71; 52/125.1; 52/125.5; 52/127.3; 52/285; 52/583; 52/704

[58] Field of Search ..... 52/69, 71, 125.2, 125.3, 52/125.4, 125.5, 125.6, 285, 583, 707, 684, 687, 704

[56] References Cited

U.S. PATENT DOCUMENTS

| | | | |
|---|---|---|---|
| 1,933,536 | 11/1933 | Awbrey | 52/707 X |
| 2,163,446 | 6/1939 | Heckman | 52/707 X |
| 2,886,370 | 5/1959 | Liebert | 52/125.3 X |
| 3,078,621 | 2/1963 | Hinds | 52/125.4 X |
| 3,337,198 | 8/1967 | Casella . | |
| 3,494,092 | 2/1970 | Johnson et al. | 52/69 X |
| 3,593,482 | 7/1971 | Johnson | 52/69 X |
| 3,600,863 | 8/1971 | Nachtsheim | 52/583 X |
| 3,724,157 | 4/1973 | Miram | 52/125.5 X |
| 3,785,095 | 1/1974 | Verner | 52/583 X |
| 3,828,512 | 8/1974 | Johnson | 52/71 X |
| 3,861,106 | 1/1975 | Erhart | 52/125.4 X |
| 3,873,147 | 3/1975 | Annable et al. | 52/704 X |
| 3,921,362 | 11/1975 | Cortina | 52/125.3 X |
| 3,952,468 | 4/1976 | Soum | 52/583 X |
| 4,173,856 | 11/1979 | Fricker | 52/125.5 |
| 4,216,633 | 8/1980 | Grauer et al. | 52/125.6 |
| 4,262,951 | 4/1981 | Hoyer | 52/125.4 |
| 4,325,575 | 4/1982 | Holt et al. | 52/125.4 X |
| 4,367,892 | 1/1983 | Holt | 52/125.5 X |

FOREIGN PATENT DOCUMENTS

| | | | |
|---|---|---|---|
| 145421 | 12/1935 | Austria . | |
| 281170 | 12/1927 | United Kingdom | 248/240 |

*Primary Examiner*—Alfred C. Perham

[57] ABSTRACT

An insert device cast integrally with the concrete for controlling the articulation of overlying and underlying slabs in Multi Slab Folding Building Construction, wherein the device provides a bar integral with the overlying slab which bar serves as connection for lifting hook used in erecting building and for picking up load of the overlying slab, and an extension of the device into a pocket provided in the underlying slab, engages a pivot in the underlying slab which pivot permits the underlying slab to rotate to a vertical position when the overlying slab is elevated, and the sides of the pocket are formed by short pieces of angle which engage the pivot, and in addition the angles are welded to bars extending from the angles to weld plates located at the base edge of the wall. After the building has been elevated, the angles and weld plates in the wall are welded to anchor plates provided in the roof and floor slabs to provide structural continuity from lower floor through the insert device to the upper slab above, where the sequence is continued the full height of the building.

9 Claims, 6 Drawing Figures

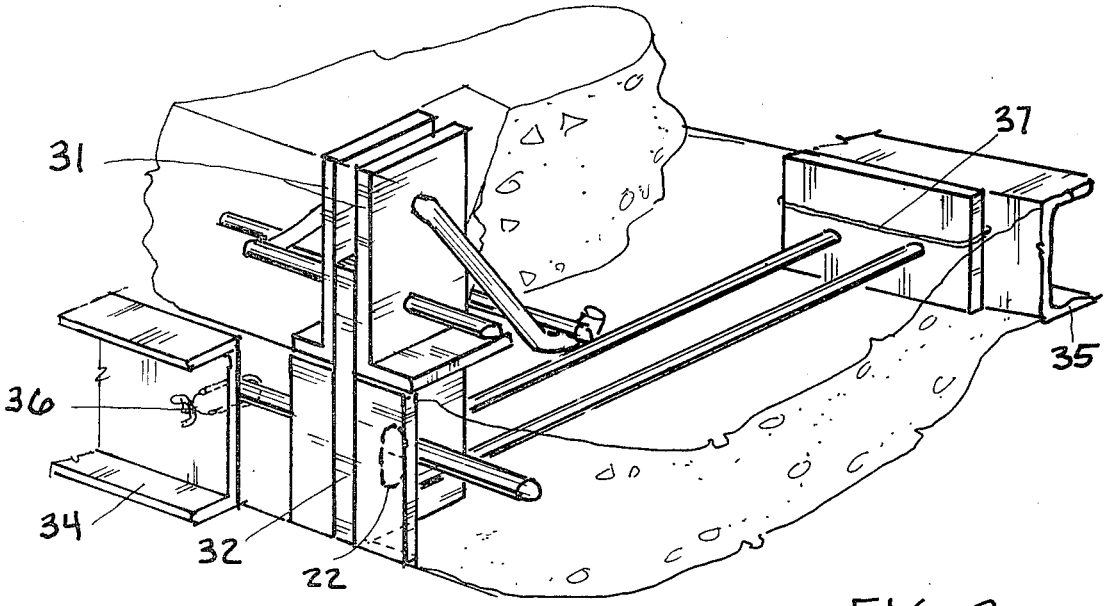
FIG. 3
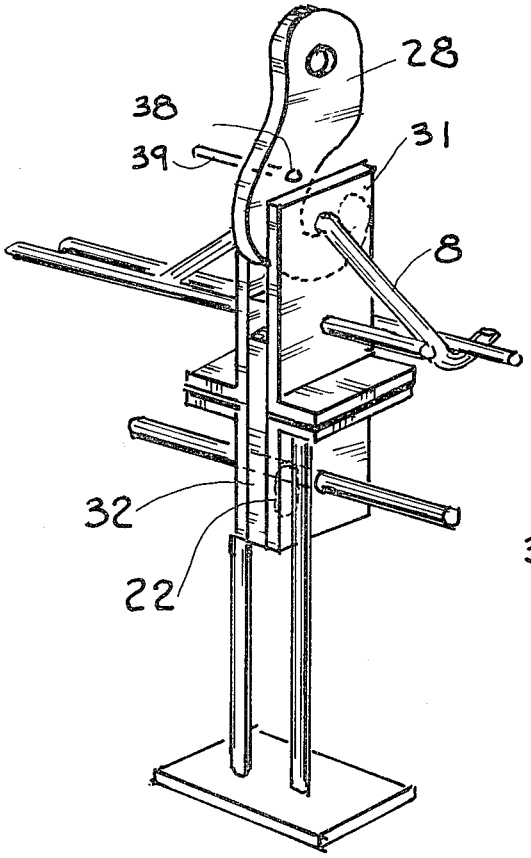
FIG 4
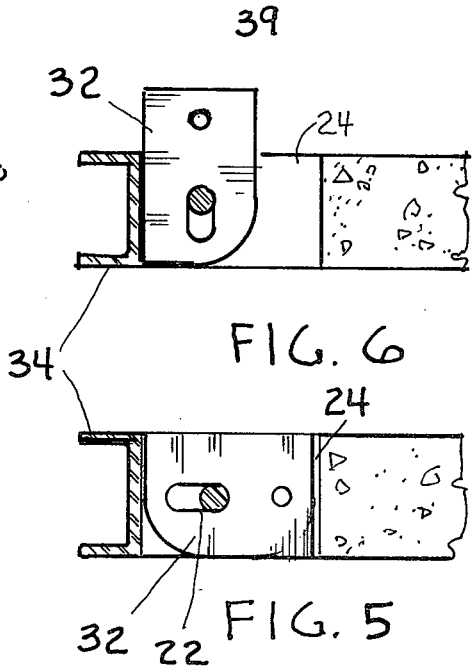
FIG. 6
FIG. 5

INSERT FOR FOLDABLE CONCRETE BUILDING CONSTRUCTION WITH PIVOT CONNECTIONS, INTEGRAL LIFTING BAR, AND BUILDING HEIGHT CONTROL BAR

BACKGROUND

In the application of the previous art regarding the subject device, including the art disclosed Johnson U.S. Pat. No. 3,494,092, and including improvements to the art, for which patents have been applied, and with particular reference to its application by unskilled labor for a U.S. Air Force Project in Turkey, it has been necessary to develop an improved method of applying the lifting force directly to the hinges without the hinges extending above the surface of the slab. This being necessary so as to not interfere with the casting of overlying units on top of the first cast unit. In addition, it is necessary to develop an improvement that would control the height of the walls and to preclude the spreading of the forms during the pouring of the concrete, which had resulted in walls of unequal heights. In addition, it is necessary to develop an insert that would not be knocked out of alignment during the concrete pour, which condition resulted in the development of overstressing during the elevating of the units. The subject invention solves the problems which had stalemated the engineers and others skilled in the art of constructing buildings by this method. The subject invention does so in a simple direct method which should contribute substantially to the efficiency and economy of the folding construction method.

DESCRIPTION OF THE DRAWINGS

FIG. 3: Shows a variation in the construction of the insert in the cast position.

FIG. 4: Shows the alternate insert in the elevated position.

FIG. 5: Shows the portion of the flat bar that extends into the underlying slab 1, separated from the portion of the insert in the overlying slab, in a position rotated so that it is below the upper surface of the underlying slab.

FIG. 6: Shows the portion of the flat bar rotated up so that it may be secured to the anchors in the overlying slab.

DETAIL DESCRIPTION OF THE DRAWINGS

Figure 1:
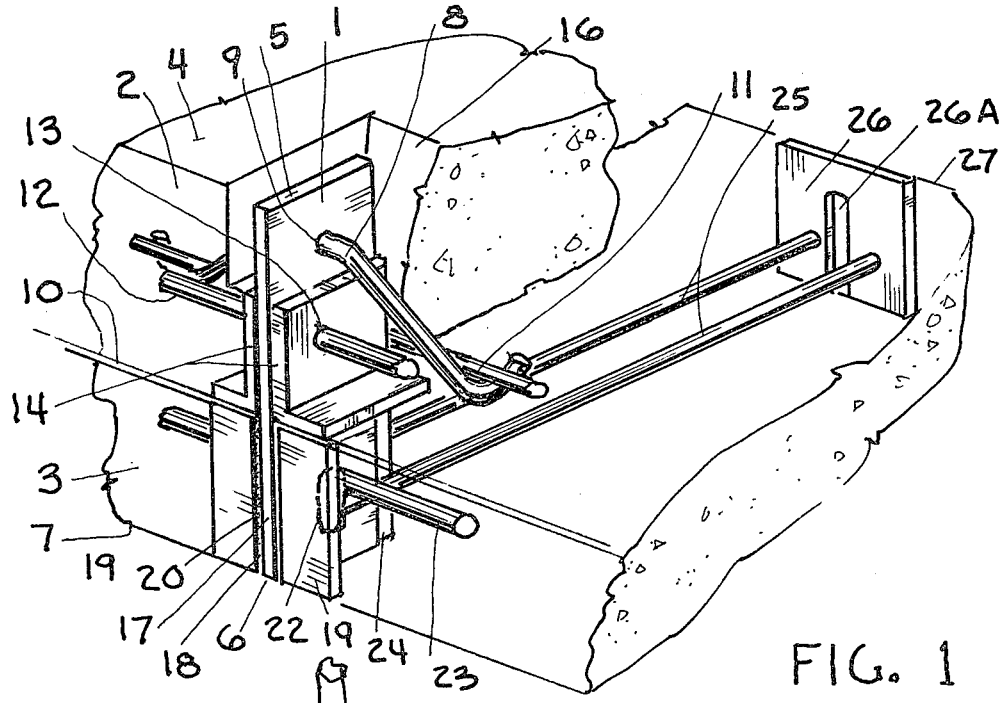
FIG. 1: Shows the insert in position as the overlying slab and underlying slabs are cast in a horizontal position.

Flat Bar 1 is shown extending through the access notch No. 16 in the overlying slab No. 2 into clearance notch No. 18 in the underlying slab 3. The end 5 of the flat bar 1 is flush with the top surface 4 of the overlying slab, and the bottom end 6 of the flat bar is flush with the surface 7 on which the slab is cast. A shaped bar 8 extends through a hole 9 in the upper portion of the flat bar 1. This bar 8 is shaped to extend down to the lower surface 10 of the overlying slab, where it is shaped to receive standard reinforcing bar 11. An additional bar 12 is extended through a hole 13 in the flat bar 1, a pair of angles 14 are positioned on each side of flat bar 1, the lower legs of angle 14 extend flush with the surface 10, and are welded to flat bar 1, a notch 16 is formed in the overlying slab 2 to provide access to bar 8 on each side of flat bar 1.

A portion 17 of flat bar 1 extends in underlying slab 3 into a notch 18, formed by angles 19. The space between the flat bar 17, and the sides of the notch 18 is filled with a thin resilient material 20, providing space for the movement of the flat bar. A slotted hole 22 in flat bar 1 engages pivot bar 23. The hole in angle 19 through which bar 23 extends, is typically positioned at the mid plane of the underlying slab so that the slab will depend vertically when the overlying slab is elevated. However, it is possible that it may be desirable to have the underlying slab depend in an other than vertical position, in which case the pivot may be located an amount offset from the mid plane as to result in the desired inclination when the underlying slab depends freely. The notch 18 may be extended beyond the two angles 19 by means of a filler as styrofoam or a sheet metal enclosure 24, to provide additional clearance for the movement of the underlying slab 3 around the flat bar 1 when the overlying slab is elevated.

A pair of bars 25 are secured to angles 19 and the bars 19 extend to an anchor plate 26, which is located at the bottom edge of the underlying slab 27. A slot 26A may be provided to facilitate welding 26 to 5.

Figure 2:
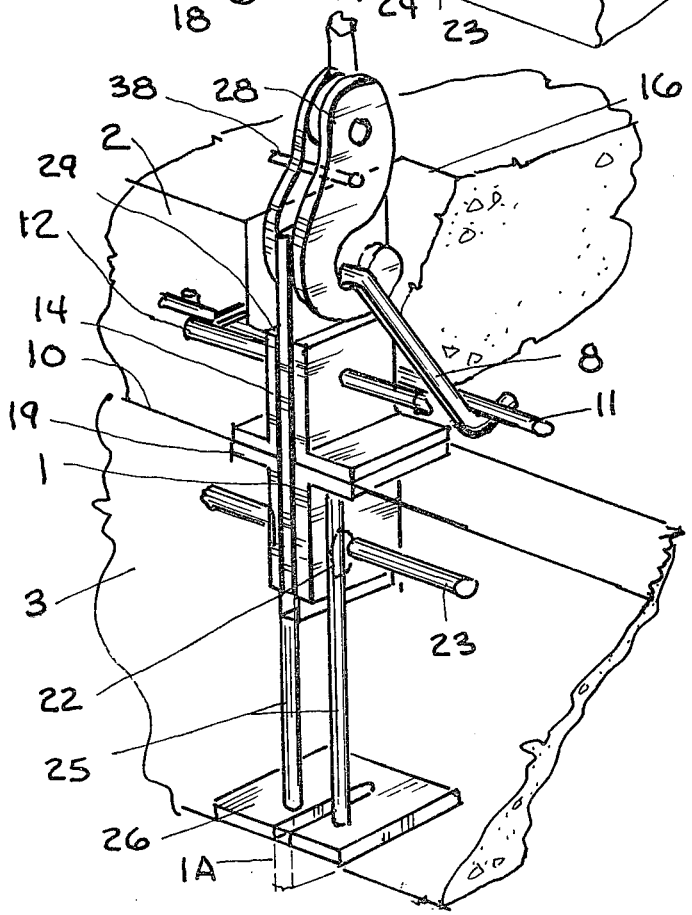
FIG. 2: Shows the insert in the elevated position, with the overlying slab horizontal and the underlying wall slab pivoted into a supportive position.

FIG. 2 illustrates the overlying slab 2 in the elevated position with the underlying slab 3 in the depending position. This shows hook 28 picking up bar 8, which is exposed by notch 16 in the overlying slab 2. Bar 11, near the lower surface 10 of the overlying slab serves to extend the load on bar 8 into the surrounding area of slab 2 to provide the required distribution of forces into the slab to pick up the weight of the overlying slab. Bar 12 serves to provide for additional distribution and to provide a fixity to the flat bar 1.

Slot 22 accommodates the movement of pivot bar 23 during the pivoting of the underlying slab 3 so that as the slab 2 is elevated, slab 3 first moves downward by the length of the slot to provide a clearange at the surface 10, to permit the rotation. The subsequent lowering of the overlying slab 2 onto the edge of slab 3 brings the angles 14 to bear on angles 19, where they can be welded.

FIG. 2 further shows the weld plate 26 at the lower end of the wall in a vertical alignment with the flat bar 1. This alignment of the weld plate and the flat bar means that in a multistory building, the weld plate can be welded to the flat bar 1A (access through notch 16) and a continuity of steel provided the full height of the building, such continuity being through bars 25. It should be noted that the bars 25, in cooperation with the angles 19, and the weld plate 26, provide the means of a precise height control of the walls, and the flat bar 1 provides a precise dimension at the overlying slab, so that the entire overall height of the building may be controlled. The upper edge 29 of angles 14 provides a limit to the downward movement of the hook 28 when the hook 28 is in a lifting position, and this limit precludes the hook from jumping free during the lift as long as a lifting force is being applied. At the same time, the notch 16 permits easy attachment and detachment of the hook during the lifting operation.

FIG. 3 shows a modification of the disclosure in FIGS. 1 and 2. This modification shows the upper portion of the insert formed by a pair of angles 31, which are secured to a flat bar 32. Flat bar 32 is provided with a slotted hole 22 to function in the same manner as in FIGS. 1 and 2.

FIG. 4 illustrates the hook between angles 31, which form the notch.

FIG. 3 shows possible edge forms 34 and 35 for pouring the walls. These may be temporarily secured to 32 and 33 by wires 36 and 37 during the pouring of the walls, and so secure the hinge and plate in position as well as the height of the wall. A pin 39 through hole 38 may be used to secure hook when lifting force is released.

FIG. 5 illustrates flat bar 32 in a position within the underlying slab, and the notch 24 required to accommodate it and provide clearance to rotate into the vertical position as shown in FIG. 6. The advantage of this separation of the device is that it permits the finishing of the underlying slab without the hinge device getting in the way of the finishers, and it assures the free pivotability of the insert within the underlying slab. In addition, by using a single bolt to secure it to the anchor in the overlying slab, a certain amount of give is provided so that, in the event there are more than two inserts used on a common edge of an underlying slab, the devices can adjust to accommodate any small misalignment of the hinges.

SUMMARY

The subject invention provides a new and novel improvement to the art of connecting and articulating slabs for folding building construction and offers several distinct advantages over the previous art, some of which are set forth below:

1. Provides lifting attachment at hinge location, thus subjecting slab to same stresses during elevating as when in final position.
2. Reduces size of extension picking up underlying slab, since the extension only has to carry weight of wall. The major weight is transferred directly through shaped bar to the lifting hook.
3. Reduces quantity of material and weight of hinge, reducing cost.
4. Applies lifting force through shaped bar to overlying slab, thus eliminating torsional forces on flat bar which tends to cause cracks at flat bar when force is transmitted through the bar.
5. Use of angles to form notch sides guarantees that they are strong enough so as not to be deformed against flat bar and permit binding, as has happened with pockets formed of sheet metal only.
6. Permits angles to serve as precise controlling device for pivot, for forming pocket, and eliminates need for separate weld plates at this location, and provides means of transmitting loads directly through flat bar.
7. Quick connect and disconnect of hook without any danger of it jumping out.
8. Utilizes the insert with the extensions to control the wall height, reducing the need for grouting in the final erection of the building.
9. Reduces the amount of welding through the directness of the connection for transferring of the loads.

IN CONCLUSION

It is believed that the subject invention provides in one single insert device for the functional requirements formerly provided by at least three separate inserts and devices: the linking device (with 30% less material), the lifting attachment for the hook, the wall height form control means for form spacing, the continuity of reinforcing means, the setting weld plate and angles made integral with the insert and the notches, the means of distributing the lifting force into the overlying slab in a more efficient manner. Applicant respectfully requests favorable action on the subject application, noting that its application to the project now underway in Turkey for the U.S. Air Force has demonstrated the need for these improvements.

I claim:

1. An insert device for hingeably connecting an overlying ceiling slab to an underlying wall slab in folding slab constructed buildings, which device, simultaneously with a lifting operation, articulates a supporting anchor located at the top edge of said wall, into position to receive a bearing anchor in said ceiling slab, and the portion of said device within the thickness of said ceiling slab, transfers the vertical loads from upper modules to lower modules in said building, said device comprising:

a flat bar extending vertically through said overlying ceiling slab, down into a clearance notch in the hinged edge of said underlying wall slab, said flat bar positioned perpendicular to and adjacent to said hinged edge; and in addition, a shaped bar extending through the upper portion of said flat bar, said shaped bar extending horizontally thru said flat bar, and thence downward from sides of said flat bar to a location near the lower surface of said overlying slab; and said shaped bar there terminating in a hook, and said hook engages reinforcing bars in said overlying slab; and in addition, a pivot bar embedded at the mid thickness of said underlying wall slab, extends thru a vertical slotted hole in said flat bar, and said slotted hole extending downward toward the bottom end of said flat bar, and the overall length of said slotted hole being at least enough to permit said pivot bar to move away from said overlying slab, the distance required to permit the said hinged edge of said underlying wall slab to rotate freely under the lower surface of said overlying slab when said overlying slab is elevated; and in addition, an access notch is formed in upper portion of said overlying slab, adjacent to said flat bar, and said access notch is of such size and position to provide access to attach a lifting connection to said shaped bar adjacent to said flat bar; and in addition, at least one support anchor within said underlying wall slab, said support anchor engaging said pivot bar with a slip fit hole, and said support anchor positioned flat against the side of said flat bar, and one edge of said support anchor being coplanar with the said hinged edge of said underlying wall slab; and said support anchor is secured to at least one reinforcing bar in said underlying wall slab; and in addition at least one bearing anchor within said overlying ceiling slab, said bearing anchor positioned flat against the side of said flat bar, and said bearing anchor being secured to said flat bar by at least one bar extending thru said flat bar and said bearing anchor; and one edge of said bearing anchor being coplanar with the lower surface of said overlying slab, and in an erected position, said bearing anchor resting on said support anchor.

2. An insert device according to claim 1, with the addition of at least one column bar, said column bar positioned within said underlying wall slab, and one end of said column bar secured to said support anchor, and the other end of said column bar terminated at the edge of said underlying wall slab, opposite to said hinged edge; and in erected position, said other end of said column bar, engages an insert device in a said lower module.

3. An insert device according to claim 2 with the addition of a foot plate secured to said other end of said column bar, and the flat side of said foot plate being coplanar with the surface of said opposite edge of said underlying wall slab.

4. An insert device according to claim 2, said underlying wall slab having top and bottom wall edge forms, said insert device having means for securement to said top and bottom wall edge forms.

5. Insert devices, each of which is according to claim 2, with the requirement, that in the erected position, all devices are of precisely the same length for each level of said building.

6. An insert device according to claim 1, with the addition of a clearance notch in the edge of said underlying wall slab, said notch of such size so as to permit said flat bar to be rotated downward to a position within the thickness of said underlying wall slab.

7. An insert device according to claim 1, with the addition of at least one flat hook shaped lifting connection, said connection being of such dimension and shape as to easily engage said shaped bar, within said access notch; and in addition, a security pin thru the side of said hook securing said hook in the connected position.

8. An insert device for hingeably connecting an overlying ceiling slab to an underlying wall slab in folding slab constructed buildings, which device, simultaneously with a lifting operation, articulates a supporting anchor located at the top edge of said wall, into position to receive a bearing anchor in said ceiling slab, and the portion of said insert device within the thickness of said ceiling slab, transfers the vertical loads from upper modules to lower modules in said building, said insert device comprising:

a flat bar extending vertically through the underlying wall slab, and up part way into the overlying ceiling slab; said flat bar positioned perpendicular to and adjacent to the hinged edge of said underlying wall slab, and in addition, at least one metal anchor within said overlying ceiling slab extending from the lower surface to the upper surface of said overlying ceiling slab, and said metal anchor being positioned flat against said flat bar; and in addition, at least one anchor bar extending through said metal anchor and said flat bar within said overlying slab; and in addition, a shaped bar extending horizontally through the upper portion of said metal anchor, and thence downward from the sides of said metal anchor, to a location near the bottom surface of said overlying slab and there terminating in a hook, and said hook engaging reinforcing bars within said overlying slab; and in addition, a pivot bar embedded at the mid thickness of said underlying wall slab extending thru a vertical slotted hole in said flat bar, and said slotted hole extending downward toward the bottom end of said flat bar, and the overall length of said slotted hole being at least enough to permit said pivot to move away from said overlying slab, the distance required to permit the said hinged edge of said underlying wall slab to rotate freely under the lower surface of said overlying slab when said overlying slab is elevated; and in addition, a clearance notch formed around said flat bar within said underlying slab, being of such size to permit said underlying slab to rotate around the lower end of said flat bar when said overlying slab is elevated; and in addition, an access notch is formed in the upper portion of said overlying ceiling slab adjacent to said metal anchor, and said access notch being of such size and position as to provide access to attach a lifting connection to said shaped bar, adjacent to said metal anchor.

9. An insert device according to claim 8, wherein said metal anchor comprises two parts, one of said parts positioned on each side of said flat bar; and said parts being secured to said flat bar by at least one anchor bar extending thru said parts and said flat bar, and said shaped bar extends thru both of said parts, and a lifting connection is extended into space between two said parts, and said lifting connection engages said shaped bar.

* * * * *